US005117600A

United States Patent [19]

Yerushalmi

[11] Patent Number: 5,117,600

[45] Date of Patent: Jun. 2, 1992

[54] BUILDING STRUCTURE HAVING HIGH BLAST AND PENETRATION RESISTANCE

[75] Inventor: Yaakov Yerushalmi, Petah Tikva, Israel

[73] Assignee: Tafi Trade and Finance Establishment, Vaduz, Liechtenstein

[21] Appl. No.: 213,568

[22] Filed: Jun. 30, 1988

[30] Foreign Application Priority Data

Jul. 16, 1987 [IL] Israel ..... 83208

[51] Int. Cl.[5] ..... E04B 2/32; E04B 1/32; E04B 5/17

[52] U.S. Cl. ..... 52/262; 52/426; 52/588; 52/589

[58] Field of Search ..... 52/405, 407, 272, 275, 52/589, 807, 806, 823, 250-252, 259, 588, 743, 426, 612, 262

[56] References Cited

U.S. PATENT DOCUMENTS

| | | | |
|---|---|---|---|
| 1,473,418 | 11/1923 | Borel | 52/259 |
| 1,530,662 | 3/1925 | Gibbons et al. | 52/378 |
| 1,618,696 | 2/1927 | Bemis | 52/259 |
| 1,957,822 | 5/1934 | Denning | 52/407 |
| 2,076,472 | 4/1937 | London | 52/489 |
| 3,012,639 | 12/1961 | Pavlecka | 52/275 |
| 4,098,042 | 7/1978 | Sachs et al. | 52/383 |
| 4,357,783 | 11/1982 | Shubow | 52/439 |
| 4,433,522 | 2/1984 | Yerushalmi | 52/426 |

*Primary Examiner*—James L. Ridgill, Jr.
*Attorney, Agent, or Firm*—Benjamin J. Barish

[57] ABSTRACT

A building structure having high blast and penetration resistance, including a plurality of walls at least one of which is of a sandwich construction including four composite panel structures each including a first group of face panels having interlocking ends, a second group of face panels having interlocking ends spaced from said first group, a plurality of laceing panels extending diagonally between the two groups of face panels and having ends interlocking with the interlocking ends of the two groups of face panels, and a filling material filling the spaces between the two groups of face panels and embedding the laceing panels. The filling material filling the spaces between the face panels is a solid material such as cast concrete, and the space between the composite panel structures is filled with a loose filling material, such as loose sand, gravel, pebbles or stones.

10 Claims, 3 Drawing Sheets

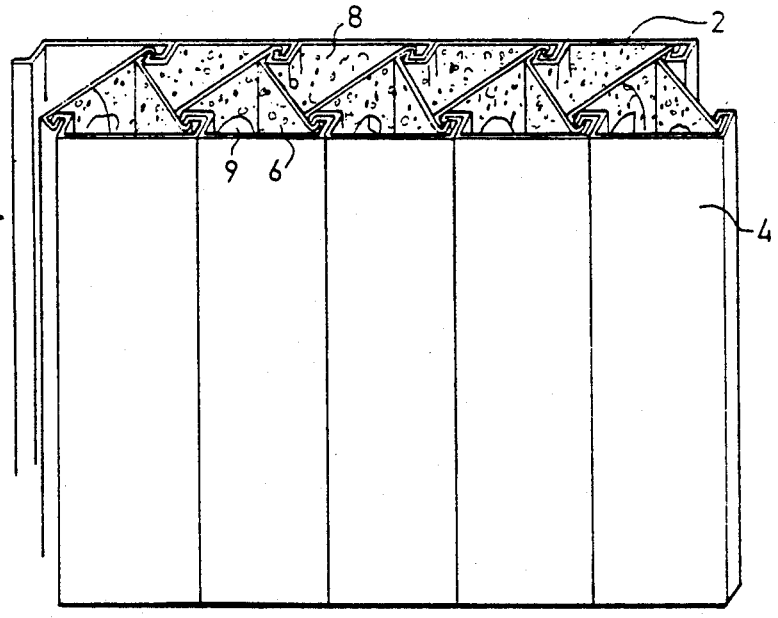
FIG 1
FIG 2
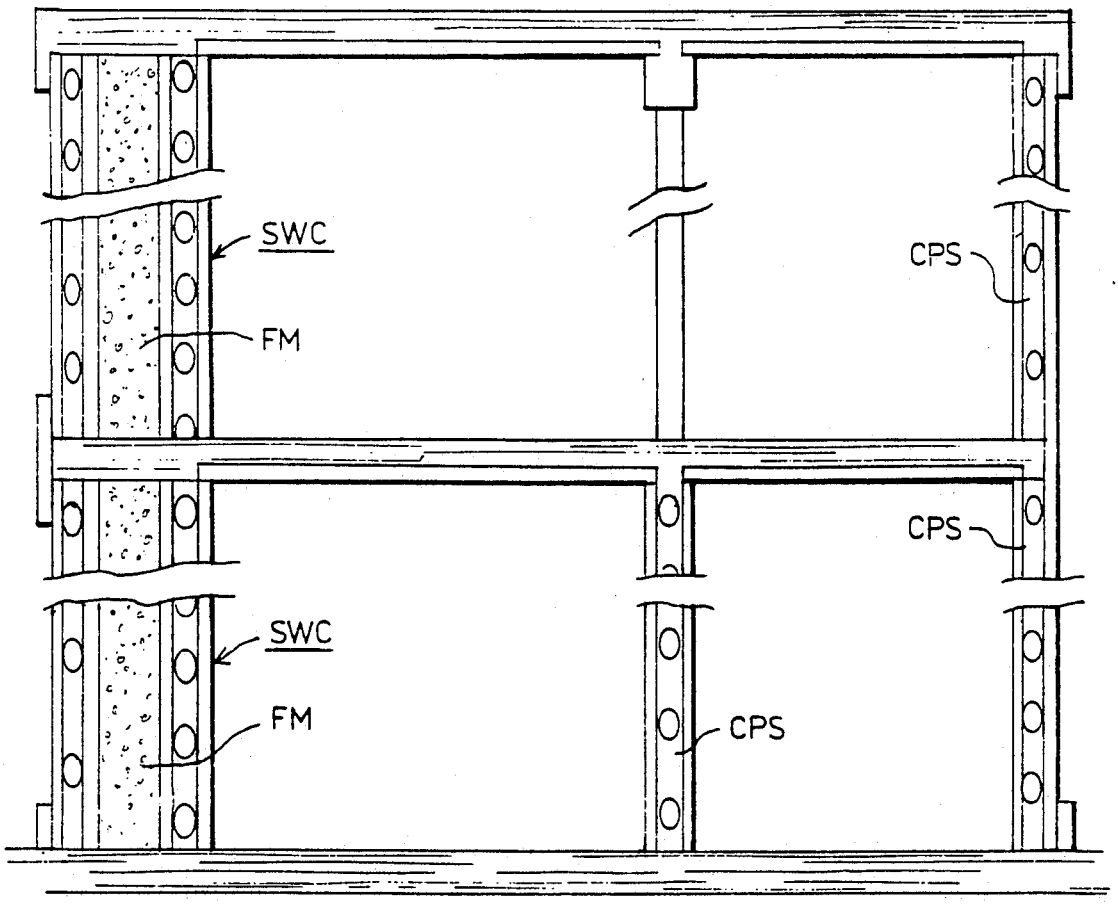

FIG 5
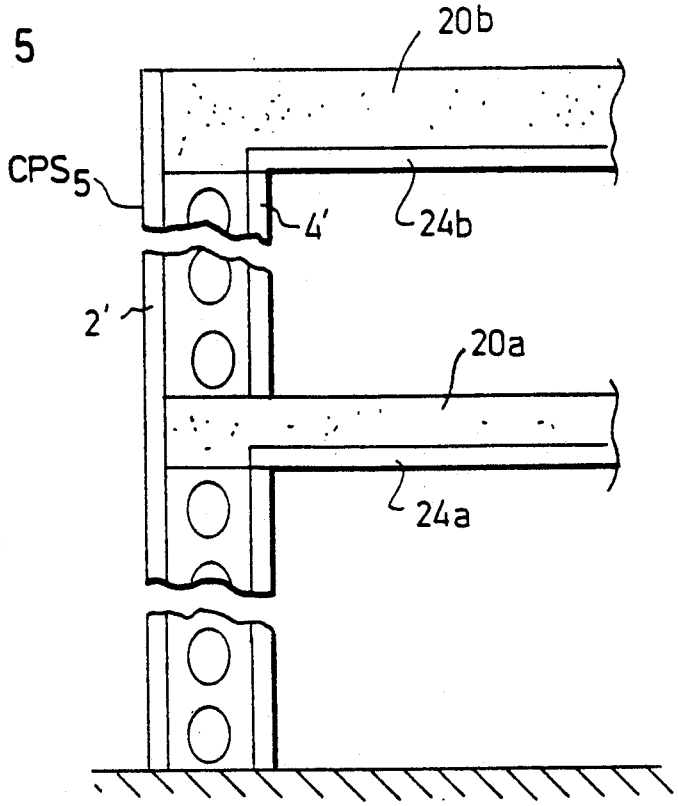
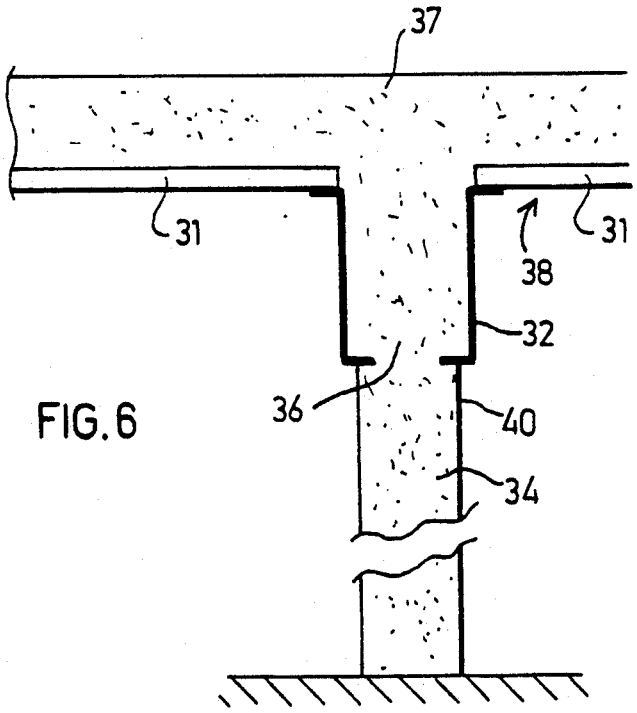
FIG. 6

BUILDING STRUCTURE HAVING HIGH BLAST AND PENETRATION RESISTANCE

BACKGROUND OF THE INVENTION

The present invention relates to a building structure, and particularly to one having high blast and penetration resistance.

The invention of the present application is based on the composite panel structure described in prior U.S. Pat. No. 4,433,522 assigned to the same assignee as the present application. Such a composite panel structure includes a first group of face panels having interlocking ends, a second group of face panels having interlocking ends and spaced from the first group, a plurality of laceing panels extending diagonally between the two groups of face panels and having ends interlocking with the interlocking ends of the two groups of face panels, and a filling material filling the space between the two groups of face panels and embedding the laceing panels. As described in the above patent, such a protective wall structure provides a high degree of resistance to fragments and also to blast, and may therefore be built of considerably smaller thickness than the conventional reinforced-concrete protective walls. In addition, such a construction exhibits a resistance to fragments ("anti-spalling") which is considerably higher than in the "laceing steel" construction, and can be built at considerably lower cost than the "laceing steel" construction.

An object of the present invention is to provide building structures based on the composite panel structure of the above-identified patent.

BRIEF SUMMARY OF THE INVENTION

According to the present invention, there is provided a building structure of high blast and penetration resistance, including a plurality of walls at least one of which is of a sandwich construction comprising: a first composite panel structure including a first group of face panels having interlocking ends, a second group of face panels having interlocking ends spaced from said first group, a plurality of laceing panels extending diagonally between the two groups of face panels and having ends interlocking with the interlocking ends of the two groups of face panels, and a filling material filling the spaces between the two groups of face panels and embedding the laceing panels; and a second composite panel structure of the same construction as the first composite panel structure and in parallel spaced relationship thereto.

According to further features in the preferred embodiment of the invention described below, the building structure comprises: a third composite panel structure of the same construction as the first and second composite panel structures and joining one of the ends of the first and second composite panel structures; and a fourth composite panel structure of the same construction as the first and second composite panel structures and joining the opposite ends of the first and second composite panel structures. In addition, the third and fourth composite panel structures are joined to the ends of the first and second composite panel structures by corner panels each formed with a right-angle bend and with interlocking ends interlocking with the ends of the outer group of face panels of the respective composite panel structure.

Preferably, the filling material filling the spaces between the face panel is cast concrete. The space between the composite panel structures may be filled with air or a loose material, such as sand, gravel, pebbles or stones.

According to a further feature of the invention, there is provided a building structure comprising: a plurality of walls at least one of which includes a composite panel structure including a first group of face panels having interlocking ends, a second group of face panels having interlocking ends and spaced from the group, a plurality of laceing panels extending diagonally between the two groups of face panels and having ends interlocking with the interlocking ends of the two groups of face panels, and a cast concrete filling material filling the spaces between the two groups of face panels and embedding the laceing panels; and a ceiling construction comprising a horizontal panel extending across and joined to the face panels of the walls, and a cast concrete slab supported on the horizontal panel and forming a monolithic structure with the cast concrete filling the spaces between the two groups of face panels of the composite panel structure of the respective wall.

According to another preferred feature in the described embodiment, the building structure further includes horizontal beams supported by the walls of the building structure and comprising a horizontal U-shaped channel member open at the top and filled with cast concrete forming a monolithic structure with the cast concrete of the ceiling and of the filling material in the space between the two face panels of the respective wall.

According to a still further preferred feature, the building structure also includes vertical columns comprising a vertical tubular member secured at its upper end to, and depending below, the horizontal U-shaped channel member, the latter member being formed with an opening establishing communication from its interior to the interior of the vertical tubular member; and cast concrete filling the vertical tubular member and forming a monolithic structure with the cast concrete of the horizontal beam, ceiling and wall.

Building structures constructed in accordance with the foregoing features provide a number of important advantages. Thus, in addition to providing a high resistance to blast and fragments, such building structures minimize, or completely obviate, the need for shuttering, scaffolding and supports during erection, and thus may be erected quickly with relatively unskilled labour and with a minimum of on-site erection equipment and preparation.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates the basic composite panel structure as described in the above-cited U.S. Pat. No. 4,433,522 used in the building structure of the present invention;

FIG. 2 illustrates one example of a multi-storey building structure constructed in accordance with the present invention;

FIG. 5 is an enlarged, vertical sectional view of a portion of the building structure of FIG. 2 more particularly illustrating the manner of forming the ceiling slabs in the roof or intermediate floors; and FIG. 6 is an enlarged, vertical sectional view of a portion of the building structure of FIG. 2 more particularly illustrating the manner of forming the horizontal beams and vertical columns.

DESCRIPTION OF A PREFERRED EMBODIMENT

Figure 3:
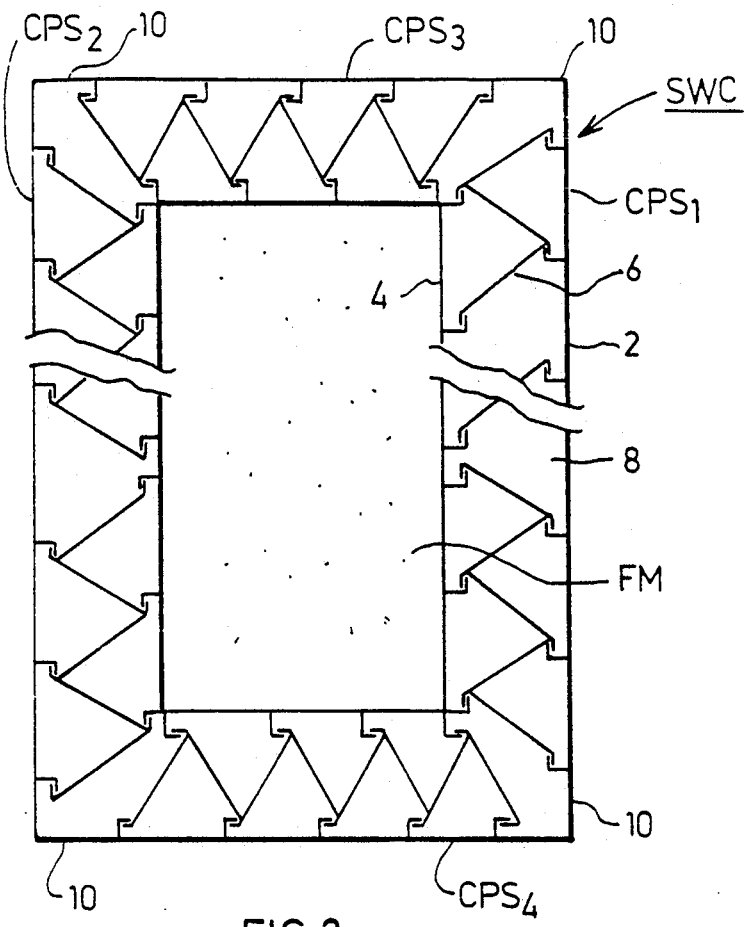
FIG. 3 is an enlarged, horizontal sectional view illustrating the sandwich wall construction used in the building structure of FIG. 2.

Reference is first made to FIG. 1 illustrating the composite panel structure, therein generally designated CPS, which is used as a basic component in erecting the building structure illustrated in FIG. 2. The composite panel structure CPS illustrated in FIG. 1 is that described in U.S. Pat. No. 4,433,522.

Briefly, the composite panel structure CPS illustrated in FIG. 1 comprises a first group of face panels 2 having interlocking ends; a second group of face panels 4 having interlocking ends and spaced from panels 2; a plurality of laceing panels 6 extending diagonally between the two groups of face panels 2, 4, and having ends interlocking with the interlocking ends of panels 2, 4; and a filling material 8 filling the spaces between the two groups of panels 2, 4 and embedding the laceing panels 6. As one example, panels 2, 4, 6 may be steel sheets of 0.8–1.2 mm thickness, and the filling 8 is preferably cast concrete. The laceing panels 6 are provided along their length with openings 9 to facilitate filling the space between the two groups of face panels 2, 4 with the filling material.

Reference may be made to the above-cited U.S. Pat. No. 4,433,522 for further details of the construction of the described composite panel structure, and also of the manner in which it produces a high resistance to blast and fragments.

The building structure illustrated in FIG. 2 of the present application includes a number of walls of the composite panel structure CPS illustrated in FIG. 1. However, it also includes a sandwich wall construction, generally designated SWC, constructed to provide an even higher degree of blast resistance than provided by the composite panel structure CPS alone. The sandwich wall construction SWC may be provided only on the side of the building structure facing the threat of a blast (as shown in FIG. 2), or may be provided on all the sides of the building structure.

Briefly, the novel sandwich wall construction is constituted of two (or more) composite wall structures CPS spaced from each other, and further filling material FM, preferably a looser material such as sand, gravel, pebbles or stones, filling the space between the two composite panel structures CPS.

Figure 3A:
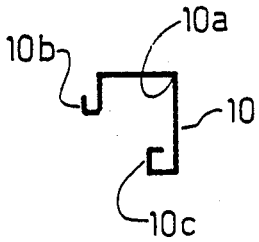
FIG. 3*a* illustrates a corner member used in making the sandwich, wall construction illustrated in FIG. 3.
Figure 4:
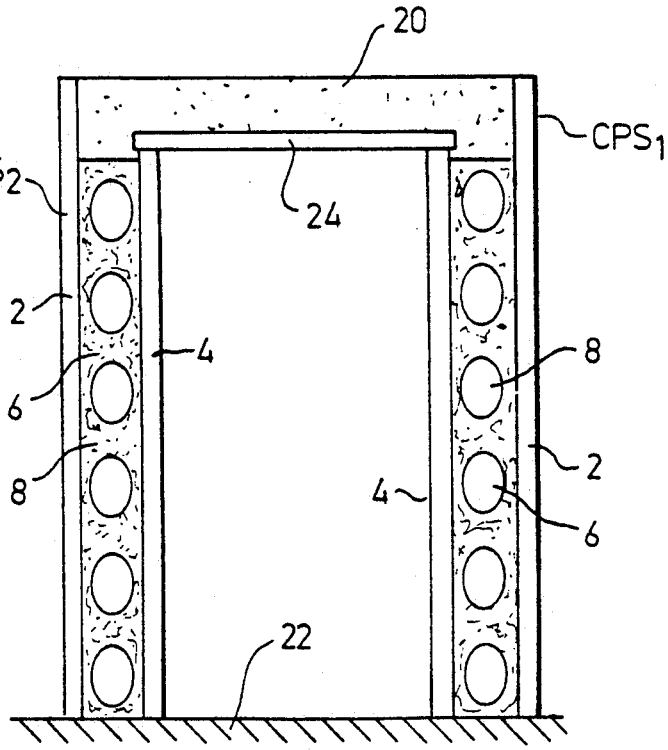
FIG. 4 is an enlarged, vertical sectional view of the sandwich wall construction illustrated in FIG. 3.

The sandwich wall construction SWC in the building structure of FIG. 2 is more particularly illustrated in FIGS. 3, 3*a* and 4. It includes a first composite panel structure $CPS_1$ facing the external side of the building structure, and a second composite panel structure $CPS_2$ facing the internal side of the building structure. Each of the two composite panel structures is as described above with respect to FIG. 1, namely including a plurality of outer, interlocking face panels 2, a plurality of inner, interlocking face panels 4, a plurality of interlocking laceing panels 6 extending diagonally between panels 2 and 4, and a filling material, preferably cast concrete, filling the spaces between the two groups of panels 2 and 4 and embedding the laceing panels 6.

The sandwich wall construction SWC illustrated in FIG. 3 further includes a third composite panel structure $CPS_3$ of the same construction and joining one of the ends of the two composite panel structures $CPS_1$, $CPS_2$, and a a fourth composite panel structure $CPS_4$ of the same construction and joining the opposite ends of the composite panel structures $CPS_1$ and $CPS_2$.

The two end structures $CPS_3$ and $CPS_4$ are joined to the opposite ends of structures $CPS_1$ and $CPS_2$ by corner members 10, more particularly illustrated in FIG. 3*a*. Corner members 10 are made of the same sheet material as the outer face panels 2 in the composite panel structures but each is formed with a right-angle bend 10*a* midway of its length so as to make a right-angle corner at the juncture of the respective two composite panel structures CPS. Thus, the two ends 10*b*, 10*c* of corner member 10 interlock with the outer face panels 2 in the two composite panel structures CPS at the respective corner.

Any suitable filling material FM may be used in the space between the composite panel structures $CPS_1$–$CPS_4$. Preferably, however, a loose filling material, such as sand, gravel, pebbles or stones, is used instead of the solid concrete filling material 8 used to fill the space between the face panels of each composite panel structures CPS; but it will be appreciated that filling material FM could also be solid concrete. The space between the composite panel structures may also be filled with air, particularly where a high degree of shock insulation is required.

As one example, each of the composite panel structures $CPS_1$–$CPS_4$ could have a thickness of 20 cm, and the thickness of the space occupied by the filling material FM could be 40 cm, whereupon the total thickness of the sandwich wall construction SWC illustrated in FIG. 3 would be 80 cm.

FIG. 4 illustrates a manner of erecting the sandwich wall construction SWC of FIG. 3 and using it for casting a concrete ceiling, therein designated 20, simultaneously with the casting of the concrete filling material 8 in the spaces between the two facing panels in each of the two composite panel structures $CPS_1$, $CPS_2$, so as to provide a monolithic structure. The base 22 of the building structure may also be of concrete, casted beforehand, or at the time of casting the ceiling 20 and the filling material 8.

As shown in FIG. 4, the two composite panel structures $CPS_1$, $CPS_2$ forming the sandwich wall construction SWC are bridged at their upper ends by a horizontal panel 24 extending across and joined to the inner face panels 4 of the two composite panels $CPS_1$, $CPS_2$. Horizontal panel 24 is preferably of the same construction as the outer interlocking face panels 2. When the concrete is thus cast above the horizontal panel 24 to form the concrete slab 20, the concrete is also caused to flow into the spaces between the face panels 2, 4 of each of the two composite panel structures $CPS_1$, $CPS_2$, to form a monolithic concrete structure including both the concrete filling material 8 in the two structures $CPS_1$, $CPS_2$, and also the concrete ceiling slab 20. Particularly good "anti-spalling" effects have been obtained when horizontal panel 24 is of the interlocked-panel construction per outer face panels 2, rather than a simple horizontal panel.

FIG. 5 illustrates the formation of ceiling slabs, corresponding to slab 20 in FIG. 4, for all the intermediate floors and also for the roof simultaneously with, and as a monolithic structure with, the concrete of the walls. Thus, as shown in FIG. 5, the composite panel structure, therein designated $CPS_5$, extends to the roof of the building structure, but its inner interlocking face panel 4' is interrupted at the location of each ceiling and roof in the multi-storey building structure. Horizontal panels 24*a*, 24*b* are applied over the ends of the inner interlocking panel 4' at each storey, and the concrete may be cast to simultaneously produce a cast concrete ceiling 20*a* for each storey, the roof 20*b*, and the concrete filling between the two face panels 2', 4', to form a monolithic structure.

FIG. 6 illustrates the manner of forming the horizontal beams 38 and the vertical columns 40 as part of the monolithic concrete structure in the building of FIG. 2. Thus, for this purpose, a horizontal panel 31, similar to panel 24 in FIG. 4, or panel 24*a*, 24*b* in FIG. 5, is supported between the walls as described above. In additional, a horizontal U-shaped channel member 32, open at the top, is mounted between two adjacent horizontal panels 31, and one or more vertical tubular members 34 are provided extending from the bottom of the horizontal channel member 32 to the floor. The horizontal channel member 32 is formed with openings or perforations 36 for each vertical tubular member 34 establishing communication between the interiors of these members. Thus, the concrete may be cast in a single operation not only to form the ceiling slab 37, but also to fill the horizontal channel member 32 to produce a horizontal beam 38, and to fill the vertical tubular member 34 to form a vertical column 40, all as a monolithic concrete construction. In addition, such an arrangement minimizes, or completely obviates, the need for shuttering and support when casting the concrete, thereby greatly simplifying and speeding-up the erection of the building structure.

While the invention has been described with respect to one preferred embodiment, it will be appreciated that many other variations, modifications and applications of the invention may be made.

What is claimed is:

1. A building structure of high blast and penetration resistance, including a plurality of walls at least one of which is of a sandwich construction comprising:

a first composite panel structure including a first group of face panels having interlocking ends, a second group of face panels having interlocking ends spaced from said first group, a plurality of laceing panels extending diagonally between the two groups of face panels and having ends interlocking with the interlocking ends of the two groups of face panels, and a filling material filling the spaces between the two groups of face panels and embedding the laceing panels;

a second composite panel structure of the same construction as said first composite panel structure and in parallel spaced relationship thereto;

a third composite panel structure of the same construction as said first and second composite panel structures and joining one of the ends of the first and second composite panel structures;

and a fourth composite panel structure of the same construction as said first and second composite panel structures and joining the opposite ends of the first and second composite panel structures;

said third and fourth composite panel structures being joined to the ends of said first and second composite panel structures by corner panels each formed with a right-angle bend and with interlocking ends interlocking with the ends of the outer group of face panels of the respective composite panel structure.

2. The building structure according to claim 1, wherein said filling material filling the spaces between the face panels is a solid material, the space between the composite panel structures being filled with a loose filling material.

3. The building structure according to claim 2, wherein said solid filling material is cast concrete.

4. The building structure according to claim 3, wherein said loose filling material is loose sand, gravel, or stones.

5. The building structure according to claim 3, further including a ceiling construction comprising a horizontal panel extending across and joined to the face panels of said first and second composite panel structures facing each other, and a cast concrete slab supported on said horizontal panel and forming a monolithic structure with the cast concrete of said first filling material.

6. A building structure comprising:

a plurality of walls at least one of which is of a sandwich construction comprising: (1) a first composite panel structure including a first group of face panels having interlocking ends, a second group of face panels having interlocking ends and spaced from said first group, a plurality of laceing panels extending diagonally between the two groups of face panels and having ends interlocking with the interlocking ends of the two groups of face panels, and a cast concrete filling material filling the spaces between the two groups of face panels and embedding the laceing panels; and (2) a second composite panel structure of the same construction as said first composite panel structure and in parallel spaced relation thereto;

and a ceiling construction comprising a horizontal panel extending across said plurality of walls of the building structure and joined to the face panels of said first and second composite panel structures in said sandwich construction, and a cast concrete slab supported on said horizontal panel and forming a monolithic structure with the cast concrete filling the spaces between the two groups of face panels in said first and second composite panel structures of said wall of sandwich construction.

7. The building structure according to claim 6, further including a horizontal beam supported by said wall of sandwich construction and comprising a horizontal U-shaped channel member open at the top and filled with cast concrete forming a monolithic structure with the cast concrete of said ceiling and of said filling material in the space between the two groups of face panels in said first and second composite panel structure of said wall of sandwich construction.

8. The building structure according to claim 7, further including a vertical column comprising a vertical tubular member secured at its upper end to, and depending below, said horizontal U-shaped channel member, said U-shaped channel member being formed with an opening therethrough establishing communication from its interior to the interior of the vertical tubular member; and cast concrete filling said vertical tubular member and forming a monolithic structure with the cast concrete of said horizontal beam, said ceiling, and said wall of sandwich construction.

9. The building structure according to claim 8, further including a cast concrete floor forming a monolithic structure with the cast concrete of said vertical column, horizontal beam, ceiling, and wall of sandwich construction.

10. The building structure according to claim 9, wherein at least one wall of the building structure is formed with said sandwich construction, and at least one other wall is made of a single composite panel structure.

* * * * *